US007441848B2

(12) United States Patent
Chen et al.

(10) Patent No.: US 7,441,848 B2
(45) Date of Patent: Oct. 28, 2008

(54) AUTOMATIC HOMING MECHANISM FOR A MULTI-SECTIONAL SLIDE

(75) Inventors: Ken-Ching Chen, Kaohsiung Hsien (TW); Shih-Long Hwang, Kaohsiung Hsien (TW); Chun-Chiang Wang, Ksohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 292 days.

(21) Appl. No.: 11/336,770

(22) Filed: Jan. 23, 2006

(65) Prior Publication Data

US 2007/0170829 A1 Jul. 26, 2007

(51) Int. Cl.
*A47B 88/00* (2006.01)

(52) U.S. Cl. ..... 312/333; 312/334.46

(58) Field of Classification Search ..... 312/333, 312/319.1, 334.1, 334.8, 334.11, 334.44, 312/334.46, 334.47; 384/18, 20, 21
See application file for complete search history.

(56) References Cited

U.S. PATENT DOCUMENTS

| | | | | |
|---|---|---|---|---|
| 5,015,048 | A | 5/1991 | Brunnert | |
| 5,020,868 | A | 6/1991 | Brunnert | |
| 5,040,833 | A | 8/1991 | Brunnert | |
| 5,040,858 | A | 8/1991 | Kruse et al. | |
| 5,207,781 | A | 5/1993 | Rock | |
| 5,240,318 | A | 8/1993 | Schroder et al. | |
| 5,302,016 | A | 4/1994 | Lautenschlager | |
| 5,364,179 | A | 11/1994 | Brustle et al. | |
| 5,474,375 | A | 12/1995 | Hollenstein et al. | |
| 5,580,138 | A | 12/1996 | Grabher | |
| 6,254,205 | B1 | 7/2001 | Wright et al. | |
| 6,340,078 | B1 | 1/2002 | Scheible | |
| 6,629,738 | B2 | 10/2003 | Salice | |
| 6,652,050 | B2 * | 11/2003 | Lin | 312/333 |
| 6,672,692 | B2 | 1/2004 | Weng | |
| 6,712,435 | B2 | 3/2004 | Kim | |
| 6,733,097 | B2 | 5/2004 | Kim et al. | |
| 6,736,471 | B2 | 5/2004 | Lin | |
| 6,799,817 | B1 | 10/2004 | Chu | |
| 6,899,408 | B2 * | 5/2005 | Chen et al. | 312/334.44 |
| 6,979,066 | B2 * | 12/2005 | Yang | 312/333 |
| 6,997,611 | B2 * | 2/2006 | Chen et al. | 384/21 |

(Continued)

FOREIGN PATENT DOCUMENTS

| | | | |
|---|---|---|---|
| EP | 0743032 | B1 | 11/1996 |

*Primary Examiner*—Janet M Wilkens
(74) *Attorney, Agent, or Firm*—Rosenberg, Klein & Lee

(57) ABSTRACT

An automatic homing mechanism for a multi-sectional slide includes a sliding block and a hooking member, or further includes a locating member of an inner rail operating in conjunction with an outer rail and a middle rail. The middle rail passes and slides on the outer rail. The sliding block is inserted and slides in a sliding holder disposed at the end of the outer rail. The sliding block is pulled back to the end of the outer rail by way of a first elastic member. A sliding channel of the sliding holder is provided with locating cuts for the sliding block to be relatively secured in position. The hooking member is pivotally connected to the middle rail corresponding in position to the sliding block and includes two hooks to hold against the sliding block by way of a second elastic member. The locating member of the inner rail is pivotally connected to the middle rail to hold against the inner rail by way of a corresponding hook.

4 Claims, 13 Drawing Sheets

U.S. PATENT DOCUMENTS 7,111,913 B2 * 9/2006 Dubon ..... 312/333
7,118,277 B2 * 10/2006 Chen et al. ..... 384/21
7,244,005 B1 * 7/2007 Lu ..... 312/333
2003/0122460 A1 * 7/2003 Chang ..... 312/334.46

* cited by examiner

AUTOMATIC HOMING MECHANISM FOR A MULTI-SECTIONAL SLIDE

BACKGROUND OF THE INVENTION (a) Field of the Invention

The present invention relates to an automatic homing mechanism for a multi-sectional slide, and more particularly, to one that automatically pulls back to the end of an outer rail, an inner rail and a middle rail during their last stage of travel when pushed back to their locations of being full retracted, and that allows return to normal function in case a sliding block of the automatic homing mechanism fails.

(b) Description of the Prior Art

While depending on a slide to execute lateral sliding by a drawer or similar object, the entire process of pulling out or pushing back the slide is usually done by the force applied by the use. Alternatively, products of slide with automatic homing mechanism are also generally available in the market. The slide with automatic homing mechanism automatically and fully retracts and secures the drawer to the storage space in the closet during the final stage of the travel to push back the drawer.

Related designs of the prior art of automatic homing slide are taught in U.S. Pat. Nos. 5,015,048, 5,020,868, 5,040,833, 5,040,858, 5,207,781, 5,240,318, 5,302,016, 5,364,179, 5,474,375, 5,580,138, 6,254,205 B1, 6,340,078 B1, 6,629,738 B2, 6,652,050 B2, 6,672,692 B2, 6,712,435 B2, 6,733,097 B2, 6,736,471 B2, 6,799,817 B1, 6,846,053 B2, 6,848,759 B2, 6,953,233 B2, 6,971,729 B1, and 6,979,066 B2; Application Published Nos. 2004/0183411 A1, 2004/0239218 A1, 2005/0104492 A1, 2005/0231083 A1; and EU Patent No. 0,743,032 B1.

All those prior arts cited above indicate that the slide adapted with an automatic homing mechanism meets well the needs of the users; and that many persons skilled in the art have been dedicating in R&D efforts in this area. The applicant of the present invention is no exception to invest continuous efforts in the development of new products such as one disclosed in the present invention.

SUMMARY OF THE INVENTION

The primary purpose of the present invention is to provide an automatic homing mechanism for a multi-sectional slide to automatically pull back to the end of an outer rail, an inner rail and a middle rail during their last stage of travel when pushed back to their locations of being full retracted, and allow return to normal function by pulling out a sliding block of the automatic homing mechanism in case the sliding block of the automatic homing mechanism fails.

To achieve the purpose, the present invention includes a sliding block, a sliding holder, and a hooking member operating in conjunction with an outer rail and a middle rail. The middle rail passes and slides on the outer rail. The sliding block includes a pair of side lugs, a pair of locking lugs, a locking channel, and a stopper linked by means of a first elastic member. The sliding holder includes locating members, a sliding channel, and a pair of locating cuts; corresponding locating members are disposed on the outer rail. Accordingly, the sliding holder is fixed to the end of the outer rail; the sliding block has its side lugs inserted to slide in the sliding channel of the sliding holder; the first elastic member is provided to the sliding holder for the sliding block to be pulled back to where in relation to the end of the outer rail; the sliding holder is temporarily secured in place by allowing the locking lugs of the sliding block to rest in the locking cuts of the sliding holder; the hooking member is disposed to the middle rail corresponding in position to the sliding block and includes a first hook, a second hook, a pivoting portion, and a second elastic member; the pivoting portion is pivoted to the middle rail; and the second elastic member allows the first and the second hooks to hold against the locking channel and the stopper of the sliding block under normal status.

Alternatively, the present invention includes a sliding block, a sliding holder, a hooking member, and a locating member of an inner rail operating in conjunction with a middle rail and an outer rail. The middle rail passes and slides on the outer rail; and the inner rail passes and slides on the middle rail. The sliding block includes a pair of side lugs, a pair of locking lugs, a locking channel, and a stopper linked by means of a first elastic member. The sliding holder includes locating members, a sliding channel, a pair of locating cuts, and corresponding locating members disposed to the outer rail. Accordingly, the sliding holder is fixed to the end of the outer rail; the sliding block is inserted by means of its side lugs into and slides in the sliding channel of the sliding holder; the first elastic member is provided to the sliding holder; the sliding holder is temporarily secured by having the locking lugs to rest in the locating cuts when the sliding block is pulled back to where in relation to the end of the outer rail; the hooking member is disposed on the middle rail corresponding in position to the sliding block and includes a first hook, a second hook, a pivoting portion, and a second elastic member; the pivoting portion is pivotally connected to the middle rail; the second elastic member allows the first and the second hooks to hold against the locking channel and the stopper under normal status; the locating member of the inner rail pivoted to the middle rail includes a protruding hook and a third elastic member; and the third elastic member allows the protruding hook to hold against a corresponding locating portion disposed on the inner rail.

The locating member of the sliding holder is a lug, and the locating members of the outer rail are an insertion channel and a plate limiter.

The locating members of the sliding holder are protruding portions, and the locating members of the outer rail are locating channels.

The locating members of the sliding holder are locating bolts, and the locating members of the outer rail are locating holes.

The locating members of the sliding holder are hooking legs, and the locating members of the outer rail are hooking channels to receive the hooking legs.

At least a protruding hook is provided to the locating member of the inner rail.

When compared to those prior art cited, the present invention provides advantages including that the present invention allows easy operation when applied to a slide composed of an outer rail, a middle rail, and an inner rail with the middle rail linked to a secondary rail to pass and slide on the outer rail. Wherein, a hooking member of the present invention operating in coordination with a sliding block allows smooth operation in automatically pulling back the inner rail and the middle rail to the end of the outer rail when both the inner rail and the middle rail are pushed back to their retracted locations; and that in the design of preventing failed operation, the sliding block to execute the automatic homing is returned to its normal status due to the elastic pivoting and driving by the hooking member, which yields excellent service life.

DETAILED DESCRIPTION OF THE PREFERRED EMBODIMENTS

Figure 1:
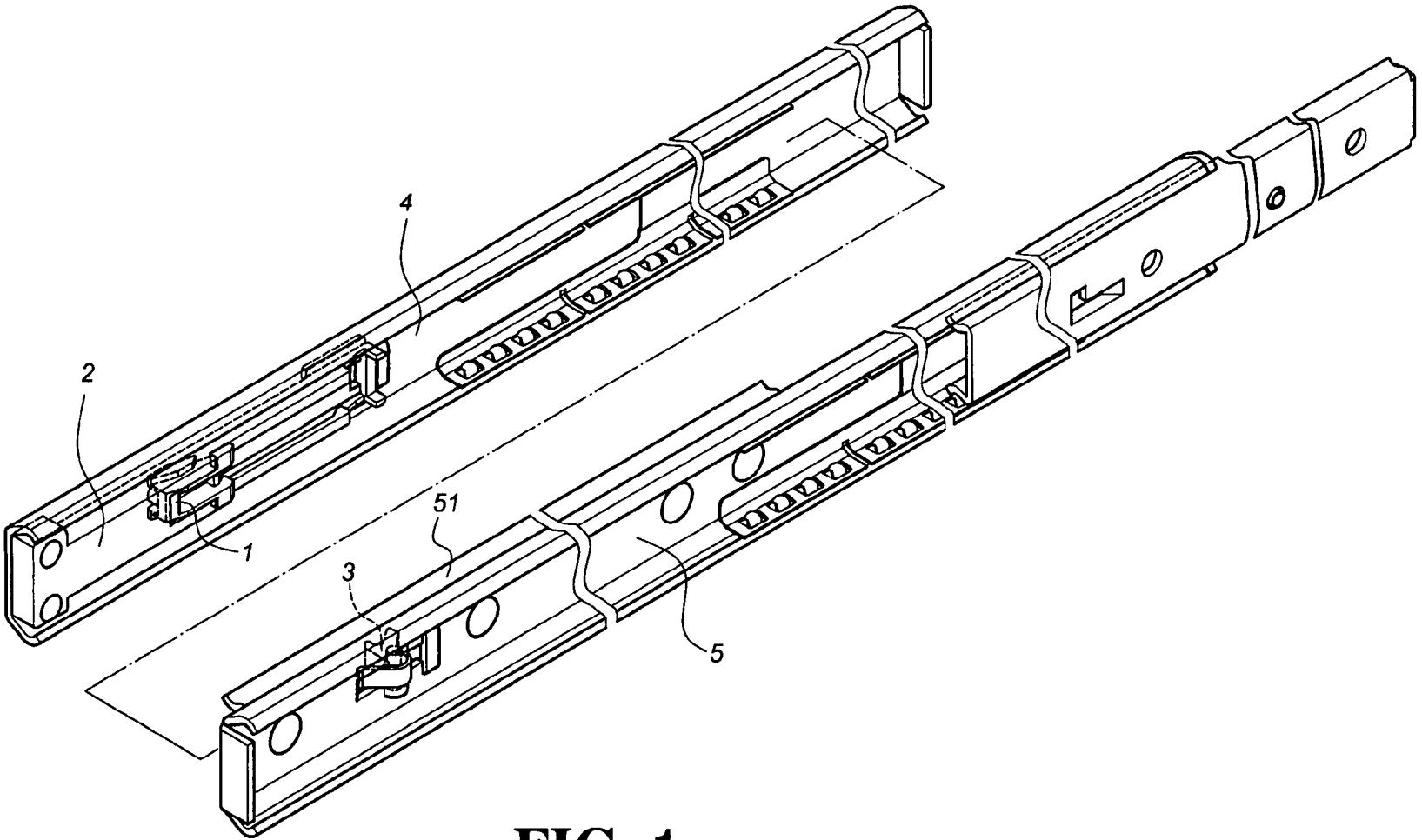
FIG. 1 is an exploded view of a preferred embodiment of the present invention applied in a three-sectional slide.
Figure 2:
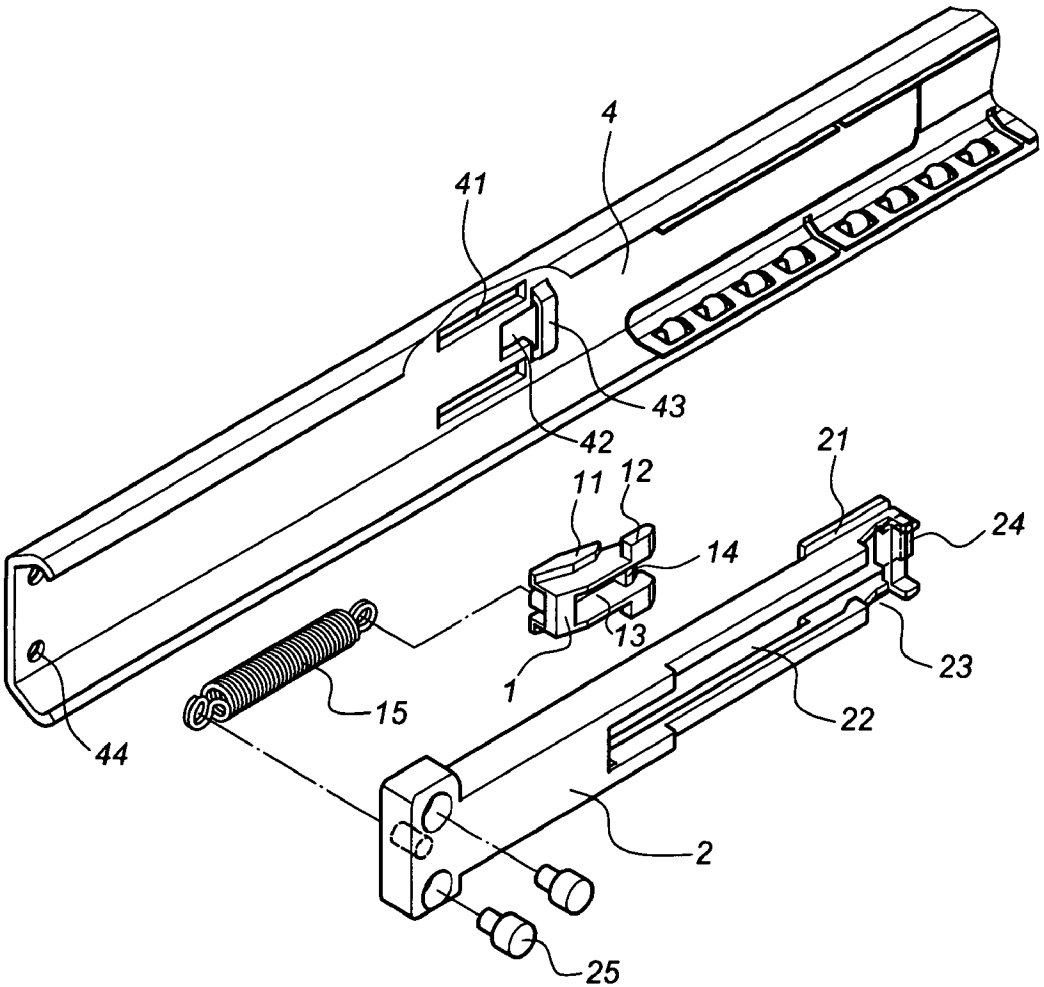
FIG. 2 is an exploded view showing details of a sliding holder of the preferred embodiment of the present invention.
Figure 3:
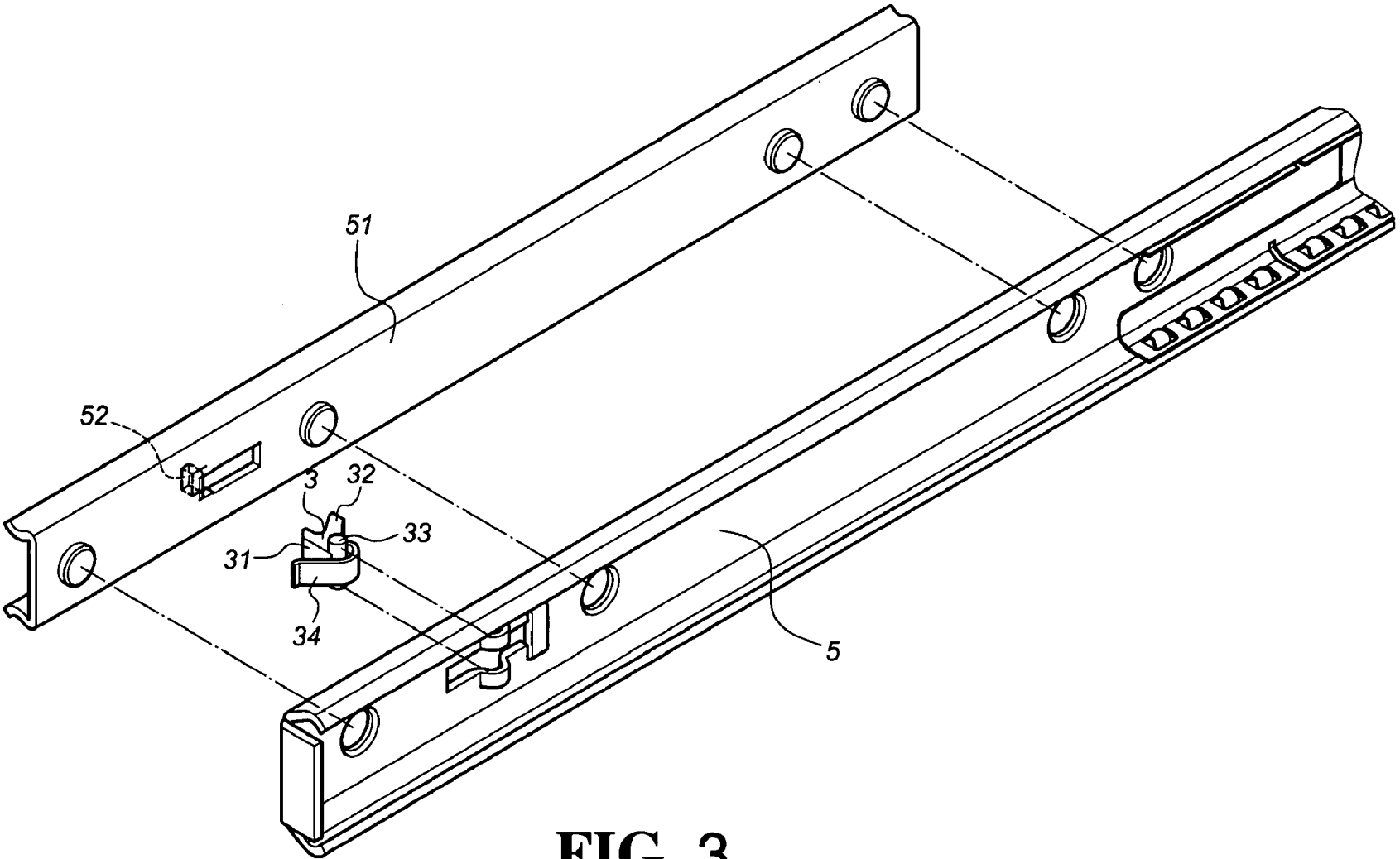
FIG. 3 is an exploded view showing a hooking member of the preferred embodiment of the present invention.

Referring to FIGS. 1, 2, and 3, a preferred embodiment of the present invention includes a sliding block (1), a sliding holder (2), and a hooking member (3) operating in conjunction with an outer rail (4) and a middle rail (5). The middle rail (5) passes and slides on the outer rail (4). The sliding block (1) includes a pair of side lugs (11), a pair of locking lugs (12), a locking channel (13), and a stopper (14) linked by a first elastic member (15). The sliding holder, (2) includes locating members [In the preferred embodiment, the locating members include a pair of protruding portions (21), a lug (24) and locating bolts (25).], a sliding channel (22), and a pair of locating cuts (23). The outer rail (4) includes corresponding locating members. [In the preferred embodiment, the locating members include a pair of locating channels (41), an insertion channel (42), a plate limiter (43), and a pair of locating holes (44).] Accordingly, the sliding holder (2) is secured to the end of the outer rail (4). [In the preferred embodiment, the protruding portions (21) are inserted into the locating channels (41); the lug (24) is placed into the insertion channel (42), restricted below the plate limiter (43), and the locating bolts (25) penetrate through the sliding holder (2) and are secured to the locating holes (44).] The sliding block (1) has the side lugs (11) to be inserted into and sliding in the sliding channel (22) of the sliding holder (2). The first elastic member (15) disposed in the sliding channel (22) of the sliding holder (2) allows the sliding block (1) to be pulled back to where in relation to that of the end of the outer rail (4). The sliding holder (2) is temporarily secured in position by permitting the locking lugs (12) to rest in the locating cuts (23) of the sliding holder (2). The hooking member (3) is disposed on the middle rail (5) corresponding in position to the sliding block (1) and includes a first hook (31), a second hook (32), a pivoting portion (33), and a second elastic member (34). The pivoting portion (33) is pivoted to where between the middle rail (5) and its secondary rail (51). Under normal conditions, the second elastic member (34) has the first hook (31) and the second hook (32) to hold against the locking channel (13) and the stopper (14) of the sliding block (1). A protruding plate (52) [formed by folding the secondary rail (51) in the preferred embodiment] is disposed on the middle rail (5) adjacent to the hooking member (3).

Figure 4:
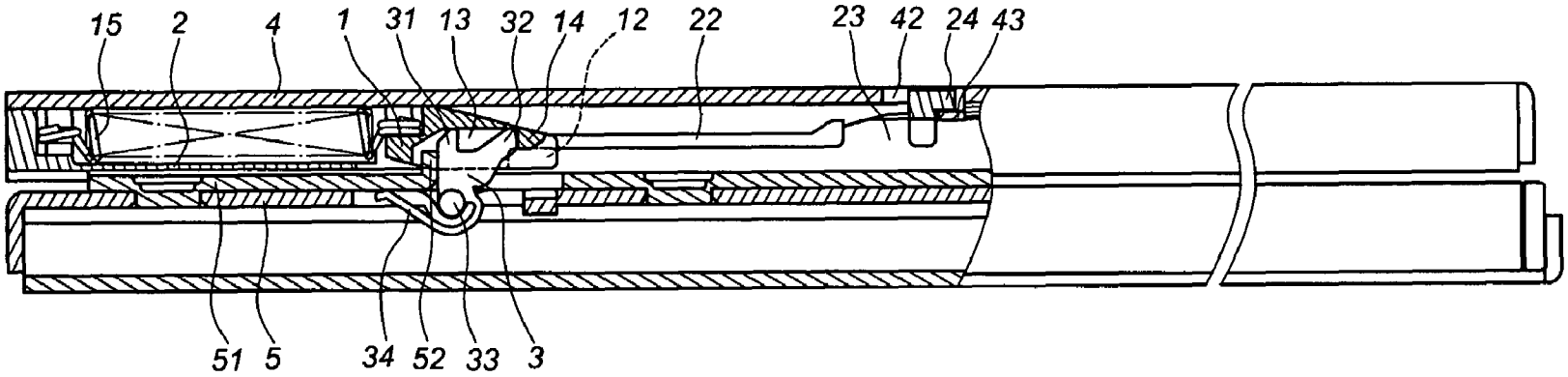
FIG. 4 is a schematic view showing an operation status of the preferred embodiment of the present invention when fully retracted.

FIGS. 4 through 7 show the operation status of the preferred embodiment under normal conditions. As illustrated in FIG. 4, the slide is in a retracted status. The sliding block (1) is located at the rear end of the sliding holder (2) as retained by the first elastic member (15) while both the first hook (31) and the second hook (32) are locked in the locking channel (13) of the sliding block (1) and restricted to the inner side of the stopper (14) [with the second hook (32) holding against the stopper (14). The sliding block (1) and the hooking member (3) hold against each other to allow the middle rail (5) to be retracted by and secured in the outer rail (4).

Figure 5:
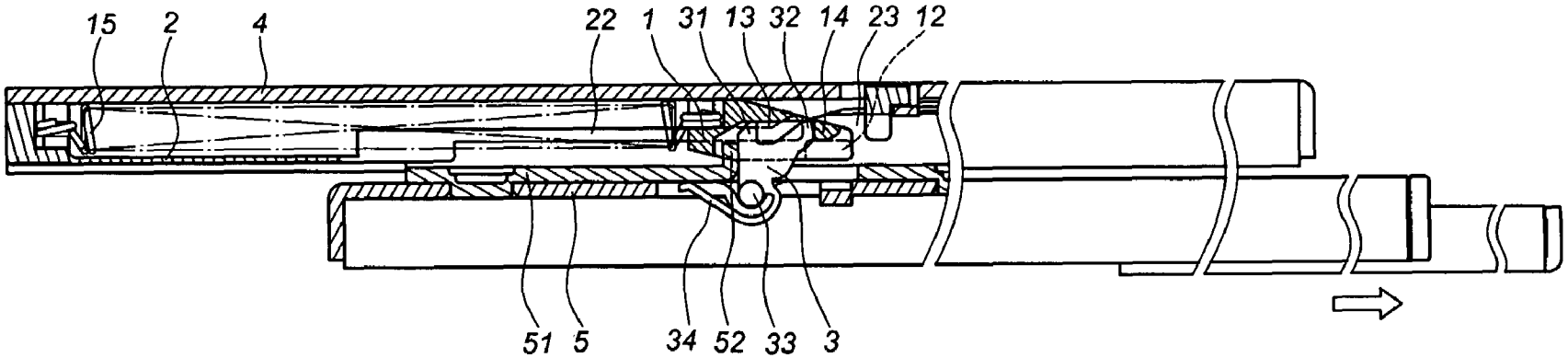
FIG. 5 is a schematic view showing another operation status of the preferred embodiment of the present invention when the hooking member pulls out a sliding block under normal conditions.

As illustrated in FIG. 5, the middle rail (5) extends in relation to the outer rail (5). Accordingly, the hooking member (3) drives the sliding block (1) to slide on the sliding holder (2) until the locking lugs (12) move to the front of the locating cuts (23) of the sliding holder (2).

Figure 6:
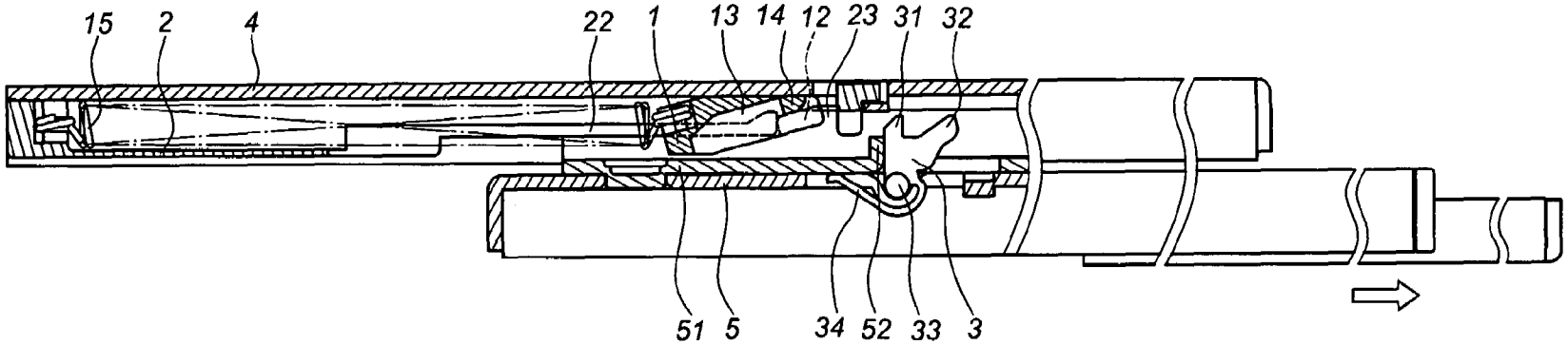
FIG. 6 is a schematic view showing another operation status yet of the preferred embodiment of the present invention when the sliding block is pulled out and secured in position under normal conductions.

The middle rail (5) further extends for a small distance in relation to the outer rail (4), as illustrated in FIG. 6, for the locking lugs (12) to slide in and to be secured in position in the locating cuts (23) of the sliding holder (2) while the hooking member (3) is continuously pulled out along with the middle rail (5).

Figure 7:
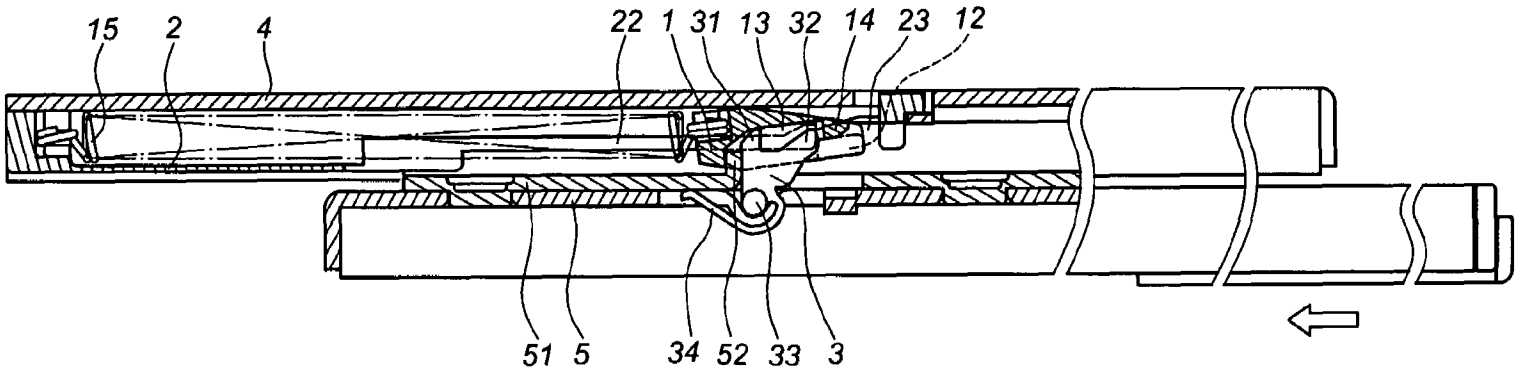
FIG. 7 is a schematic view showing another operation status yet of the preferred embodiment of the present invention when the sliding block is just automatically returned to its home when retracted under normal conditions.

Now referring to FIG. 7 for a schematic view showing that the middle rail (5) is retracted once again. After the middle rail (5) is retracted, both the first hook (31) and the second hook (32) of the hooking member (3) are located into the locking channel (13) of the sliding block (1) with the protruding plate (52) of the middle rail (5) holding against the sliding block (1) so that the locking lugs (12) clear out of the locating cuts (23) of the sliding holder (2) and the stopper (14) holds against the hooking member (3) to complete the automatic homing by having the first elastic member (15) to pull back the sliding block (1) and the middle rail (5).

Figure 8:
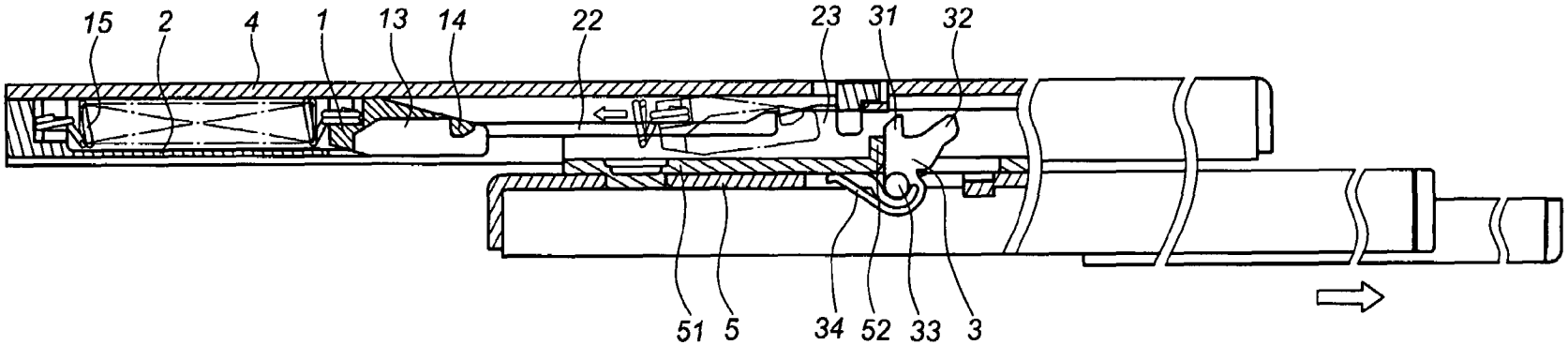
FIG. 8 is a schematic view showing another operation status yet of the preferred embodiment of the present invention when the hooking member is pulled but the sliding holder is bounced back under abnormal conditions.
Figure 9:
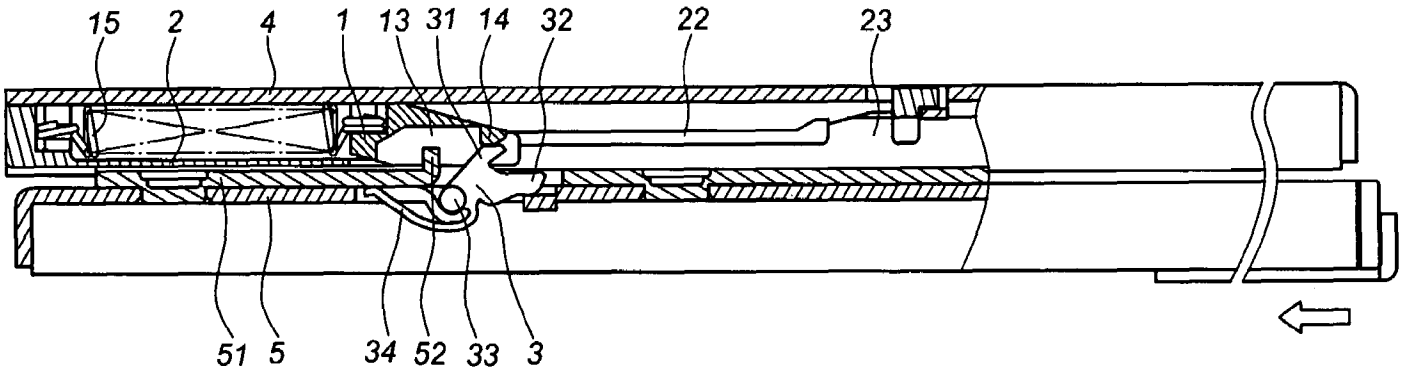
FIG. 9 is a schematic view showing another operation status yet of the preferred embodiment of the present invention when the hooking member merely holds against the sliding block during the troubleshooting.
Figure 10:
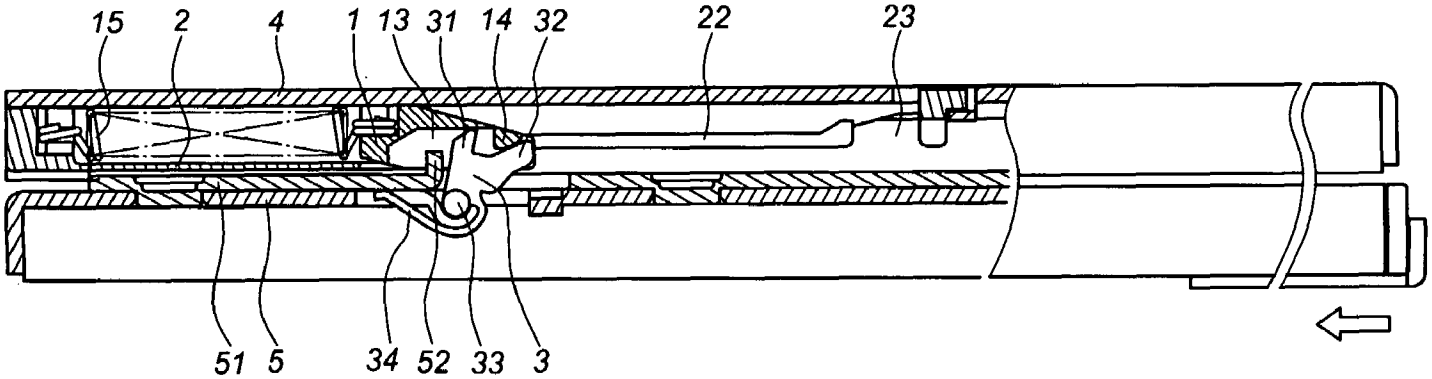
FIG. 10 is a schematic view showing another operation status yet of the preferred embodiment of the present invention when the hooking member holds against the sliding block once again during the troubleshooting.
Figure 11:
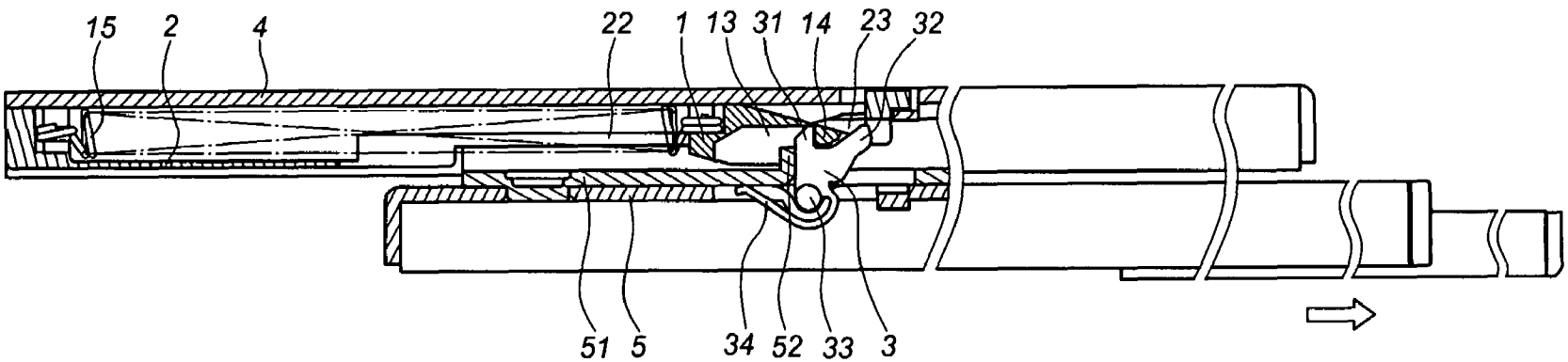
FIG. 11 is a schematic view showing another operation status yet of the preferred embodiment of the present invention when the hooking member already hooked upon the sliding block is pulled out once again during the troubleshooting.

In case of any abnormal operation, i.e., the operation of having the locking lugs (12) of the sliding block (1) to fall in the locating cuts (23) of the sliding holder (2) fail. For example, the sliding block (1) for being subject to the vibration caused by external force bounces back to the rear end of the sliding holder (2) in the course of being pulled or after having been secured in position as illustrated in FIGS. 8 through 11. FIG. 8 is a schematic view showing the locking failure; wherein, the sliding block (1) is disengaged from the hooking member (3) and bounced back to the retracted position. For troubleshooting as illustrated in FIG. 9, the middle rail (5) is pushed back again [of course, since the middle rail (5) is pulled out, it can be pushed back again after the use. Although automatic homing is not executed in the operation of pulling back the middle rail (5), the automatic homing function is restored next time when the middle rail (5) is pulled out.] Whereas the hooking member (3) provides the function of deflection, the first hook (31) once holds against the stopper (14) of the sliding block (1) immediately and automatically deflects. The first hook (31) of the hooking member (3), as illustrated in FIG. 10, hooks into the locking channel (13); and as illustrated in FIG. 11 with the middle rail (5) and the hooking member (3) being pulled out, the first hook (31) engages with the stopper (14) to further pull out the sliding block (1) for the locking lugs (12) of the sliding block (1) to once again slide into the locating cuts (23) of the sliding holder (2) to complete the positioning process thus to correct the failure.

Figure 12:
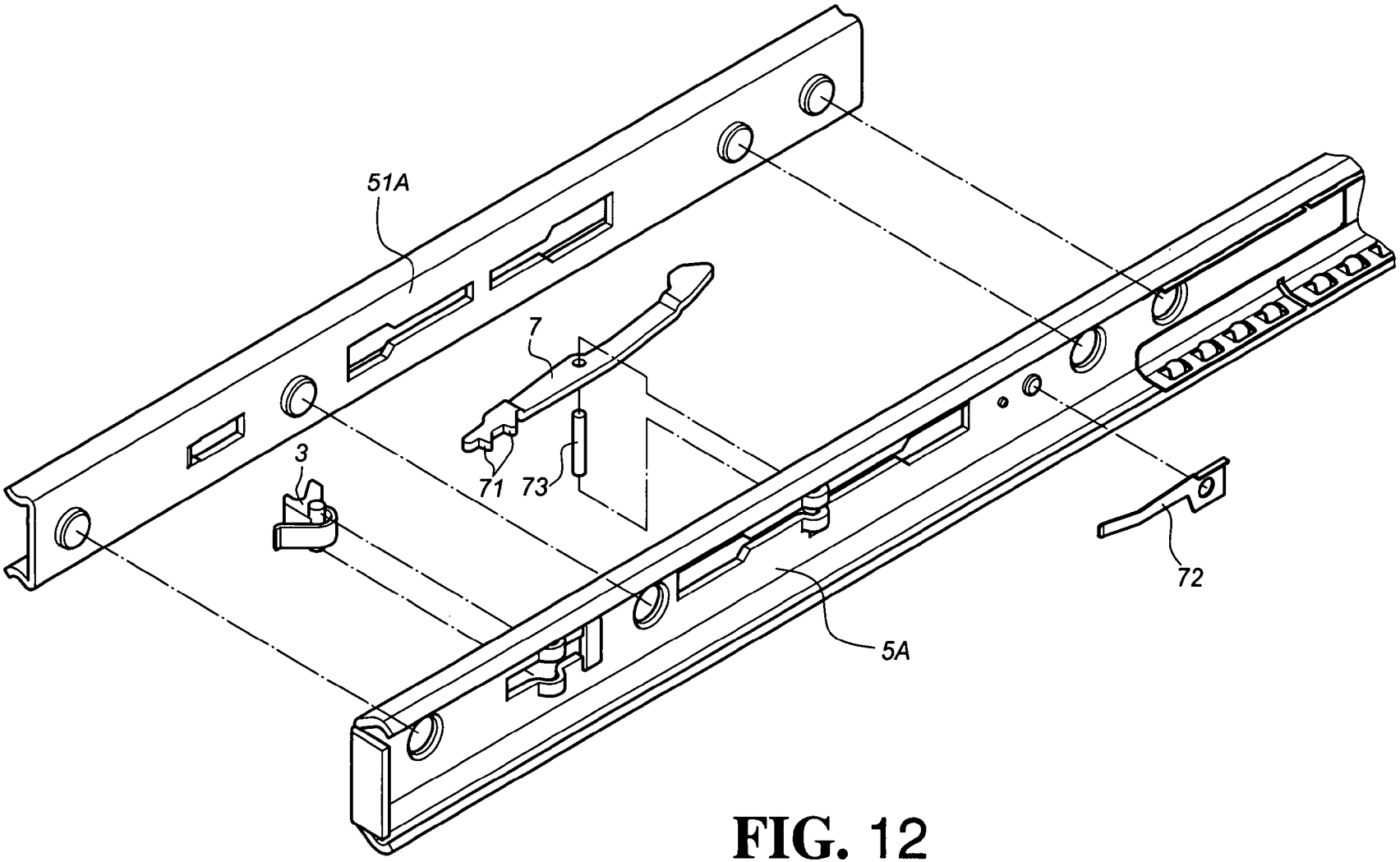
FIG. 12 is an exploded view showing details of a hooking member and a locating member of the inner rail of a second preferred embodiment of the present invention.
Figure 13:
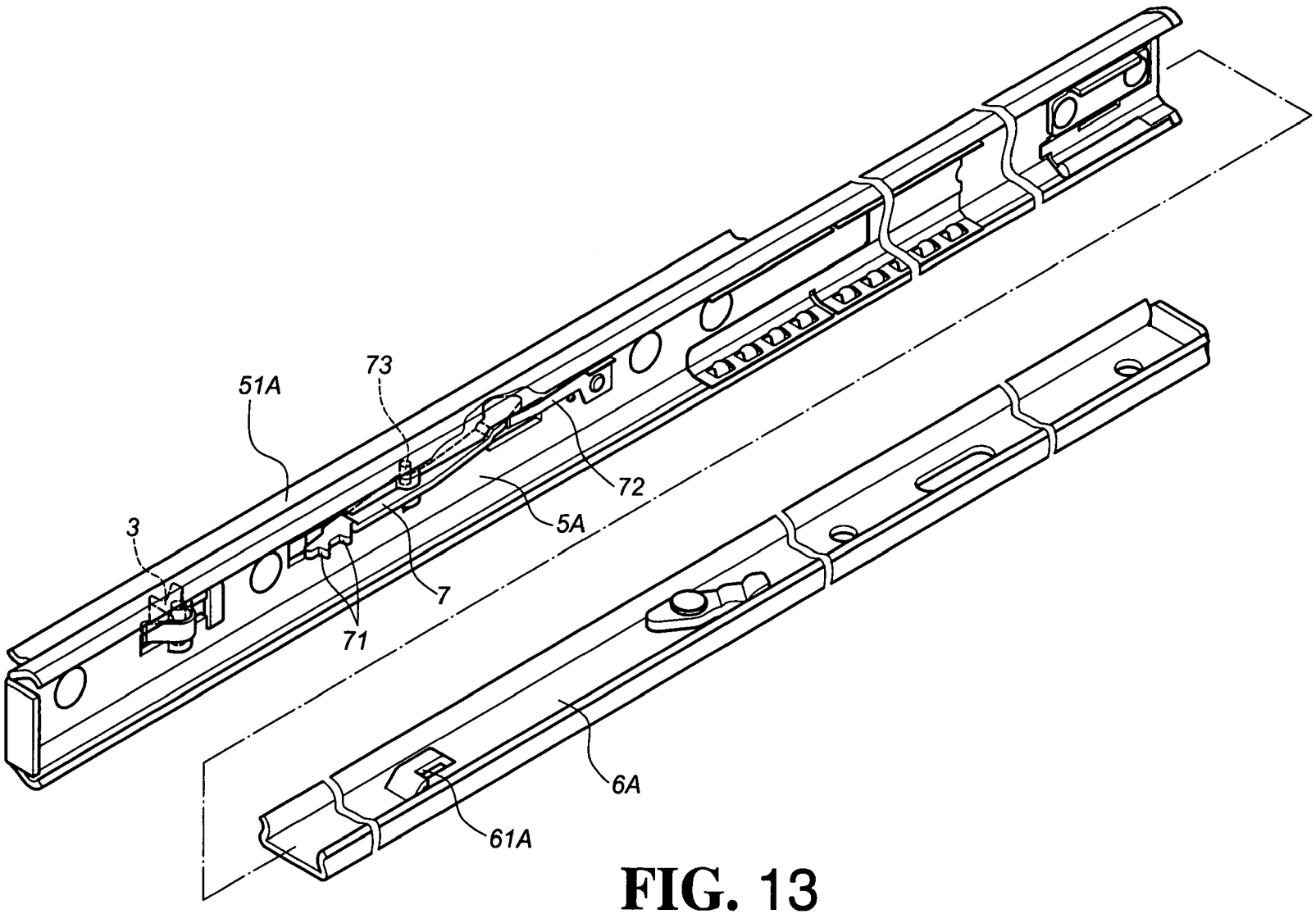
FIG. 13 is a schematic view showing a combination of the hooking member and the locating member of the inner rail of the second preferred embodiment.

As illustrated in FIGS. 12 and 13 and referring to FIG. 1, another preferred embodiment of the present invention includes the sliding block (1), the sliding holder (2), the hooking member (3), and a locating member (7) of an inner rail operating in conjunction with the outer rail (4) [in same construction as that illustrated in FIG. 1, therefore, description is not repeated], a middle rail (5A), and an inner rail (6A). Whereas the sliding block (1), the sliding holder (2), and the hooking member (3) are each in the same construction as that given in the first preferred embodiment, their description is omitted herein. The locating member (7) is pivoted to the middle rail (5A) and passes through its secondary rail (51A) to swing. The locating member (7) includes at least a protruding hook (71), a third elastic member (72), and a pivoting pin (73). The locating member (7) is pivoted to the middle rail (SA) by means of the pivoting pin (73). The inner rail (6A) is provided with a corresponding locating portion (61A) and the protruding hook (71) holds against the locating portion (61A) of the inner rail (6A) by means of the third elastic member (72).

Figure 14:
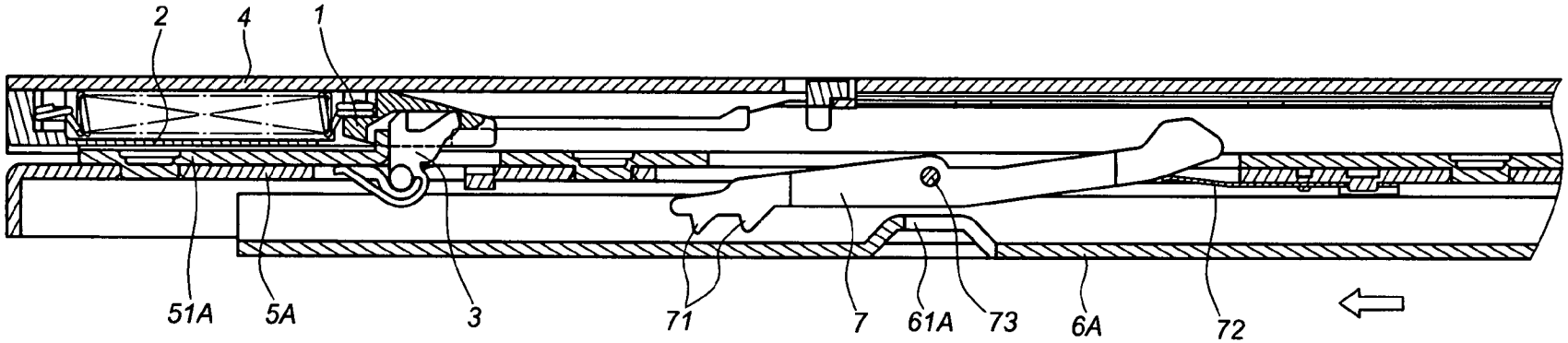
FIG. 14 is a schematic view showing an operation status of the second preferred embodiment of the present invention when the locating member has not yet located the inner rail.
Figure 15:
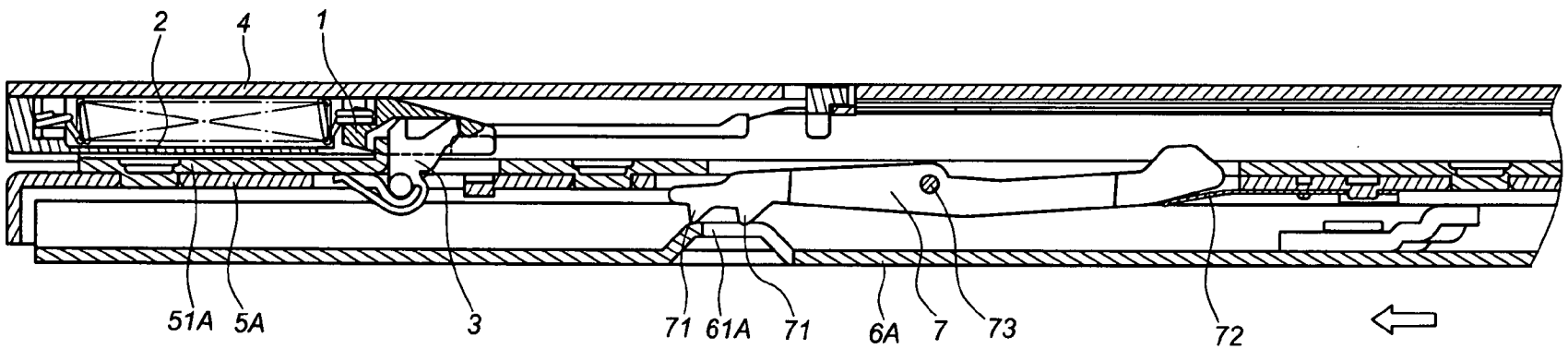
FIG. 15 is a schematic view showing an operation status of the second preferred embodiment of the present invention when the locating member is about to locate the inner rail.
Figure 16:
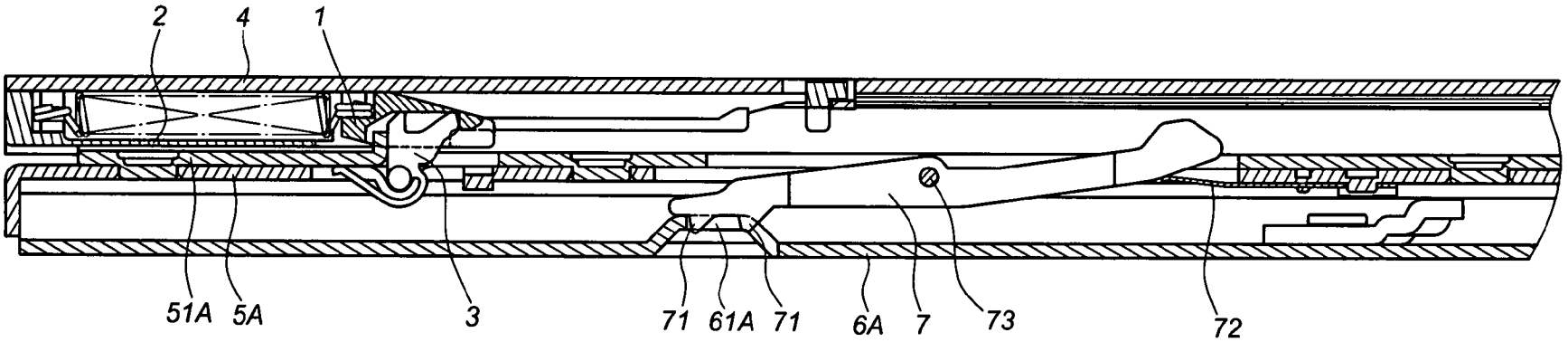
FIG. 16 is a schematic view showing an operation status of second preferred embodiment of the present invention when the locating member has fully located the inner rail.
Figure 17:
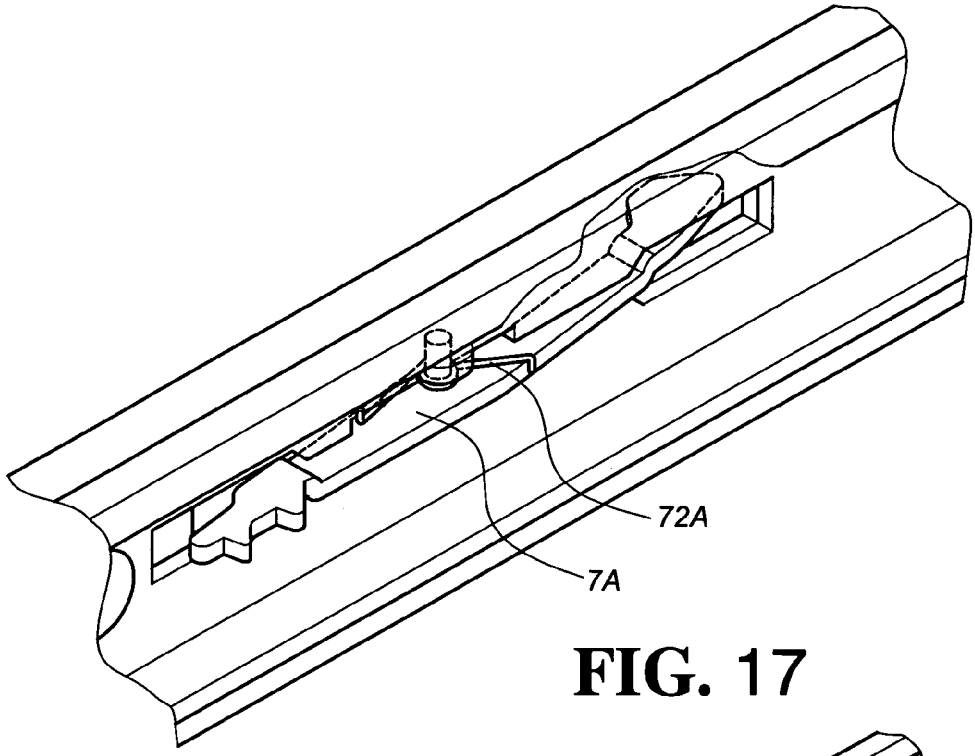
FIG. 17 is a perspective view showing a third elastic member of the second preferred embodiment of the present invention.

FIGS. 14 and 15 show the operation status of the locating member (7). When the inner rail (6A) is not fully retracted as illustrated in FIG. 14, the protruding hook (71) of the locating member (7) has not yet arrived at the locating portion (61A) of the inner rail (6A). When the locating member (7) moves to the locating portion (61 A) as illustrated in FIG. 15, the locating portion (61 A) automatically lifts up the protruding hook (71) of the locating member (7); and immediately, the locating member (7) for being subject to the force applied by the third elastic member (72) has the protruding hook (71) to once again lock the locating portion (61A) of the inner rail (6A) thus to cause the inner rail (6A) to be retracted in position in relation to the middle rail (5A) as illustrated in FIG. 16. Now referring to FIG. 17, a third elastic member (72A) adapted to a locating member (7A) is a torsion spring.

Figure 18:
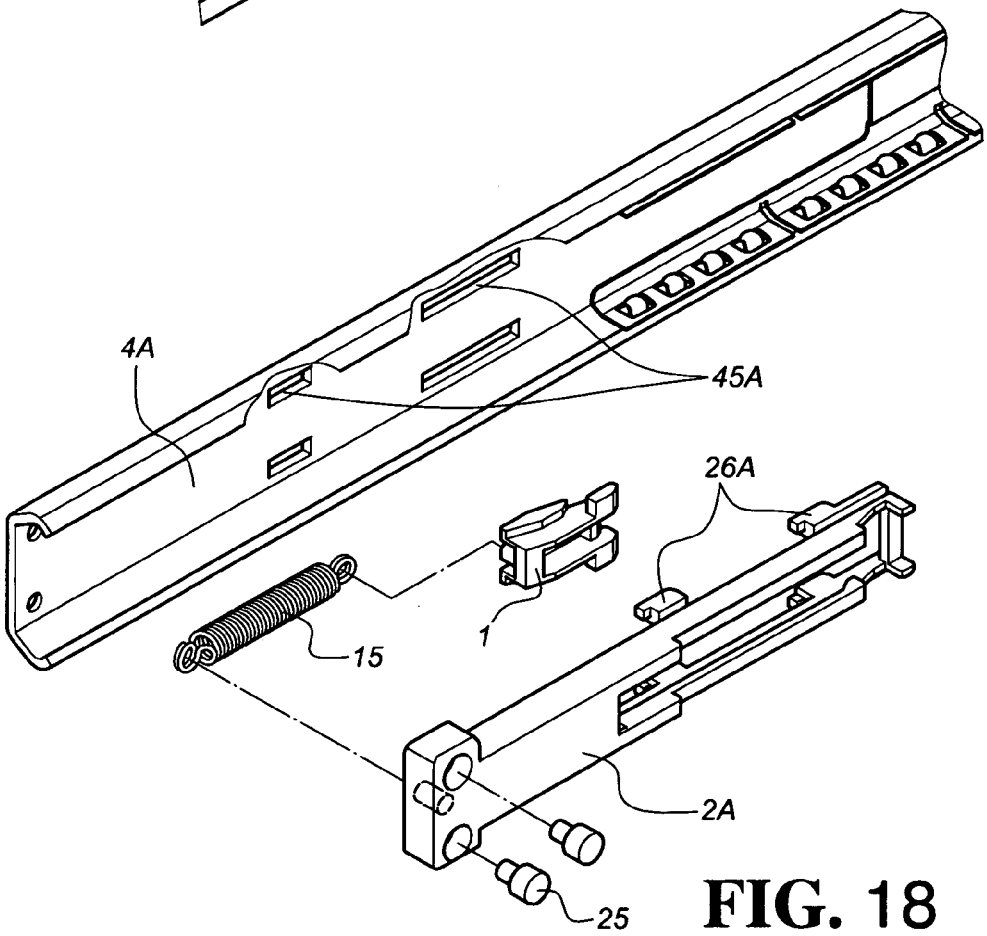
FIG. 18 is an exploded view showing details of a sliding holder of a third preferred embodiment of the present invention.
Figure 19:
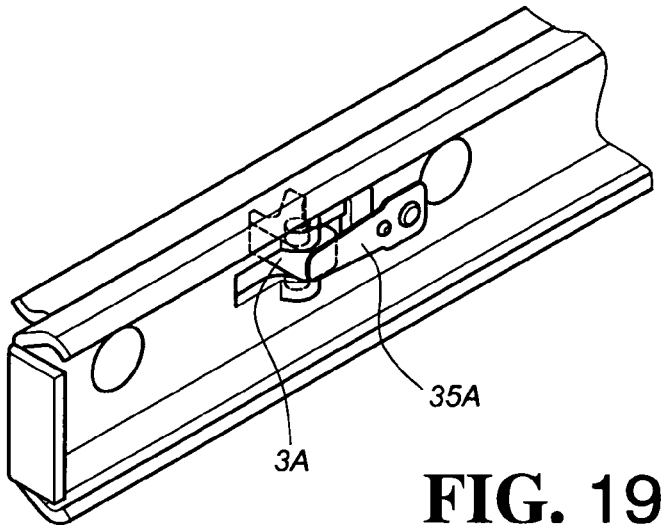
FIG. 19 is a perspective view showing a hooking member of the third preferred embodiment of the present invention.
Figure 20:
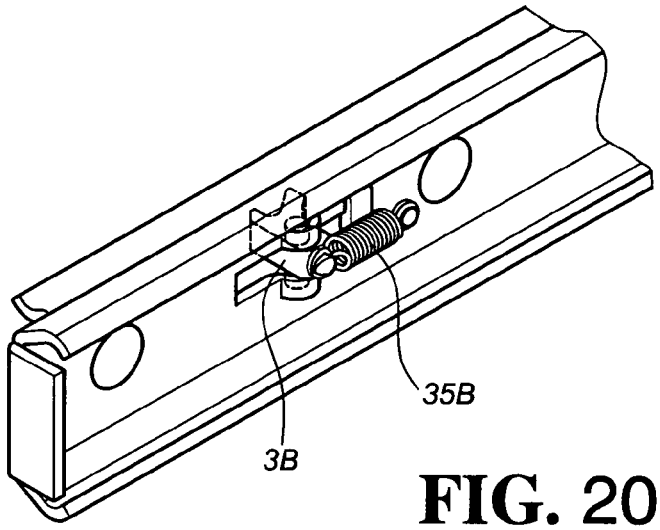
FIG. 20 is a perspective view showing a hooking member of a fourth preferred embodiment of the present invention.
Figure 21:
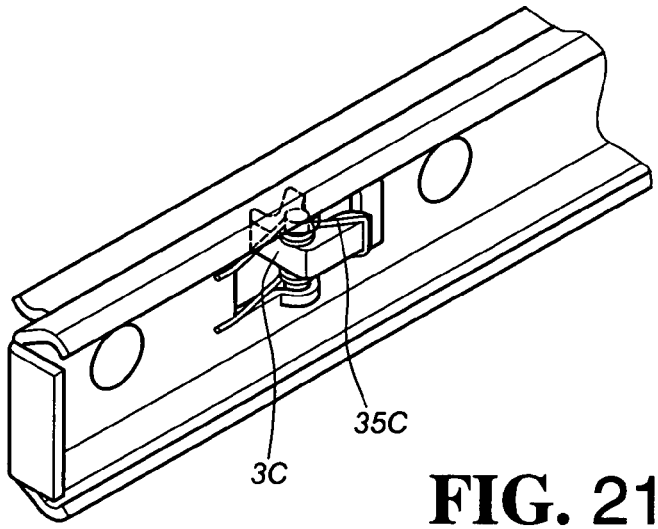
FIG. 21 is a perspective view showing a hooking member of a fifth preferred embodiment of the present invention.

As illustrated in FIG. 18, the locating members of a sliding holder (2A) may be connected and secured in place by having hooking legs (26A) to engage hooking channels (45A) of the locating members of an outer rail (4A); or alternatively, to a hooking member (3A), (3B) and (3C) respectively illustrated in FIGS. 19, 20, and 21. As illustrated in FIG. 19, a second elastic member (35A) is an elastic plate. As shown in FIG. 20, a second elastic member (35B) is an extension spring. As shown in FIG. 21, a second elastic member (35C) is a torsion spring.

What is claimed is:

1. An automatic homing mechanism for a multi-sectional slide including:

a first elastic member;

an outer rail;

a middle rail slidably connected to the outer rail;

a sliding block, including a pair of side lugs, a pair of locking lugs, a locking channel, and a stopper linked to the first elastic member;

a sliding holder securely connected to one end of the outer rail, the sliding holder including a sliding channel, and a pair of locating cuts, and the sliding block is inserted into and slides in the sliding channel of the sliding holder by means of the side lugs and is temporarily secured in place by allowing the locking lugs of the sliding block to rest in the locating cuts;

a hooking member being disposed to the middle rail corresponding in position to the sliding block, the hooking member including a first hook, a second hook, a pivoting portion, and a second elastic member wherein said first hook and said second hook are engaged with the locking channel and the stopper of the sliding block, and said second elastic member allows the first hook and the second hook to hold against the locking channel and the stopper of the sliding block, and the pivoting portion of the hooking member being pivotally connected to the middle rail wherein the middle rail includes a protruding plate disposed adjacent to the hooking member on the middle rail to hold against the sliding block; and wherein the first elastic member being disposed on the sliding holder pulls back the sliding block.

2. The automatic homing mechanism for a multi-sectional slide of claim 1, wherein the sliding holder includes a lug; the outer rail includes an insertion channel and a plate limiter; and the lug is inserted into and secured below the plate limiter.

3. The automatic homing mechanism for a multi-sectional slide of claim 1, wherein the sliding holder includes protruding portions; the outer rail includes locating channels; and the protruding portions are inserted into the locating channels.

4. The automatic homing mechanism for a multi-sectional slide of claim 1, wherein the sliding holder includes locating bolts; the outer rail includes locating holes; and the locating bolts penetrate through the sliding holder to be secured to the locating holes.

* * * * *